US007198056B2

(12) United States Patent
Silva

(10) Patent No.: US 7,198,056 B2
(45) Date of Patent: Apr. 3, 2007

(54) HIGH PURITY CHEMICAL DELIVERY SYSTEM

(76) Inventor: David James Silva, 11081 Negley Ave., San Diego, CA (US) 92131

( * ) Notice: Subject to any disclaimer, the term of this patent is extended or adjusted under 35 U.S.C. 154(b) by 231 days.

(21) Appl. No.: 11/055,225

(22) Filed: Feb. 10, 2005

(65) Prior Publication Data

US 2006/0174942 A1 Aug. 10, 2006

(51) Int. Cl.
*B67D 5/54* (2006.01)

(52) U.S. Cl. ..... 137/209; 137/240

(58) Field of Classification Search ..... 137/209, 137/240

See application file for complete search history.

(56) References Cited

U.S. PATENT DOCUMENTS 5,330,072 A * 7/1994 Ferri et al. ..... 222/1
5,964,230 A 10/1999 Voloshin et al.
6,047,744 A * 4/2000 Jackson ..... 141/21
6,138,691 A 10/2000 Voloshin et al.
6,431,229 B1 8/2002 Birtcher et al.
6,648,034 B1 11/2003 Birtcher et al.
6,953,047 B2 * 10/2005 Birtcher et al. ..... 137/240
7,114,531 B2 * 10/2006 Silva ..... 141/3
2003/0131885 A1 7/2003 Birtcher et al.
2006/0011258 A1 * 1/2006 Silva ..... 141/63

FOREIGN PATENT DOCUMENTS

JP 2004-063833 2/2004

* cited by examiner

*Primary Examiner*—Eric Keasel
*Assistant Examiner*—Craig Schneider
(74) *Attorney, Agent, or Firm*—Themis I.P.C.

(57) ABSTRACT

A high purity chemical delivery system is provided that connects a high purity chemical container to a high purity chemical utilization point and that comprises three manifolds, each of the manifolds having a plurality of diaphragm valves. The inventive system enables rapid clean out and purge after the container is replaced by means of a plurality of vacuum and purge cycles, which remove residual chemical and entrapped impurities while reduced manufacturing downtimes compared with systems in the prior art.

13 Claims, 4 Drawing Sheets

HIGH PURITY CHEMICAL DELIVERY SYSTEM

STATEMENT REGARDING FEDERALLY SPONSORED REASEARCH AND DEVELOPMENT

Not applicable.

REFERENCE TO A COMPUTER LISTING, A TABLE, OR A COMPUTER PROGRAM LISTING COMPACT DISK APPENDIX

Not applicable.

BACKGROUND OF THE INVENTION

1. Field of the Invention

The present invention concerns a high purity chemical delivery system, and, more particularly, a high purity chemical delivery system enabling a rapid clean out and purge of any high purity chemical residues.

2. Description of Related Art

High purity chemical delivery systems are typically composed of manifolds having diaphragm valves and low dead space connectors. In the semiconductor industry, for instance, low vapor pressure high purity chemicals such as tetrakis (dymethilamino) titanium (TDMAT), tetrakis (diethylamino) titanium (TDEAT), tantalum pentaethoxide (TAETO), copper hexafluoroacetylacetonate-trimethylvinylsilane (Cu(hfac)TMVS), tetramethyltetracyclosiloxane (TMCTS), tetraethyl ortosilicate (TEOS), and trimethylphosphate (TMP) are delivered from primary storage canisters to process tools or to secondary storage canisters by means of manifolds that incorporate a plurality of diaphragm valves and that regulate the flow of the chemicals during ordinary process conditions and the flow of pressurized gases and of vacuum during purge cycles. These manifolds are detachably connected by low dead space connectors, such as VCR and low obstruction fittings, in order to minimize any entrapments of the high purity chemical within the dead spaces of the connectors and thereby reduce purge cycles.

When a storage container has exhausted the supply of high purity chemical and must be replaced, the delivery system connected to the container must be thoroughly purged after the new container is installed, in order to remove any impurities and any ambient gases that have entered the system during the canister replacement process. Due to the high purity levels required, these purge cycles are extremely time consuming causing manufacturing costs to increase due to the related manufacturing down-time and to the costs of the purge materials.

Therefore, there is a need for a high purity chemical delivery system minimizing the time required for clean out and purge.

BRIEF SUMMARY OF THE INVENTION

A high purity chemical delivery system is provided that comprises three manifolds, and that is connected to a high purity chemical container having a push gas inlet port and a high purity chemical delivery port.

The first manifold comprises a first low dead space connector connecting the first manifold to the high purity chemical delivery port; a second low dead space connector for connecting the first manifold to the second manifold; and a third low dead space connector for connecting the first manifold to the third manifold. The first manifold also comprises a first diaphragm valve having one side connected to the first low dead space connector and to a second diaphragm valve, and the other side connected to the second low dead space connector; and a second diaphragm valve having one side connected to the first diaphragm valve, and the other side connected to the third low dead space connector.

The second manifold comprises a fourth low dead space connector connecting the second manifold to the third manifold, and a fifth low dead space connector connecting the second manifold to the push gas inlet port. The second manifold also comprises a third diaphragm valve having one side connected to the second low dead space connector and to a fourth diaphragm valve, and the other side connected to a high purity chemical utilization point; and a fourth diaphragm valve having one side connected to the third diaphragm valve, and the other side connected to a fifth diaphragm valve and to a sixth diaphragm valve. The fifth diaphragm valve instead has one side connected to the fourth diaphragm valve, and the other side connected to a seventh diaphragm valve; the seventh diaphragm valve has one side connected to the fifth diaphragm valve and to the fourth low dead space connector, and the other side connected to a vacuum transducer; the sixth diaphragm valve has one side connected to the fourth diaphragm valve and to an eighth diaphragm valve, and the other side connected to a ninth diaphragm valve; the eight diaphragm valve has one side connected to the sixth diaphragm valve and to a tenth diaphragm valve, and the other side connected to a pressure transducer; the ninth diaphragm valve has one side connected to the fifth low dead space connector, and the other side connected to a source of push gas; and the tenth diaphragm valve has one side connected to the eighth diaphragm valve, and the other side connected to a source of purge gas.

The third manifold comprises an eleventh diaphragm valve having one side connected to the third low dead space connector, and the other side connected to a twelfth diaphragm valve, which instead has one side connected to the fourth means for connecting, and the other side connected to the eleventh diaphragm valve and to a thirteenth diaphragm valve. In turn, the thirteenth diaphragm valve has one side connected to the twelfth diaphragm valve, and the other side connected to an outer source of vent or of vacuum.

BRIEF DESCRIPTION OF THE SEVERAL VIEWS OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

Figure 1:
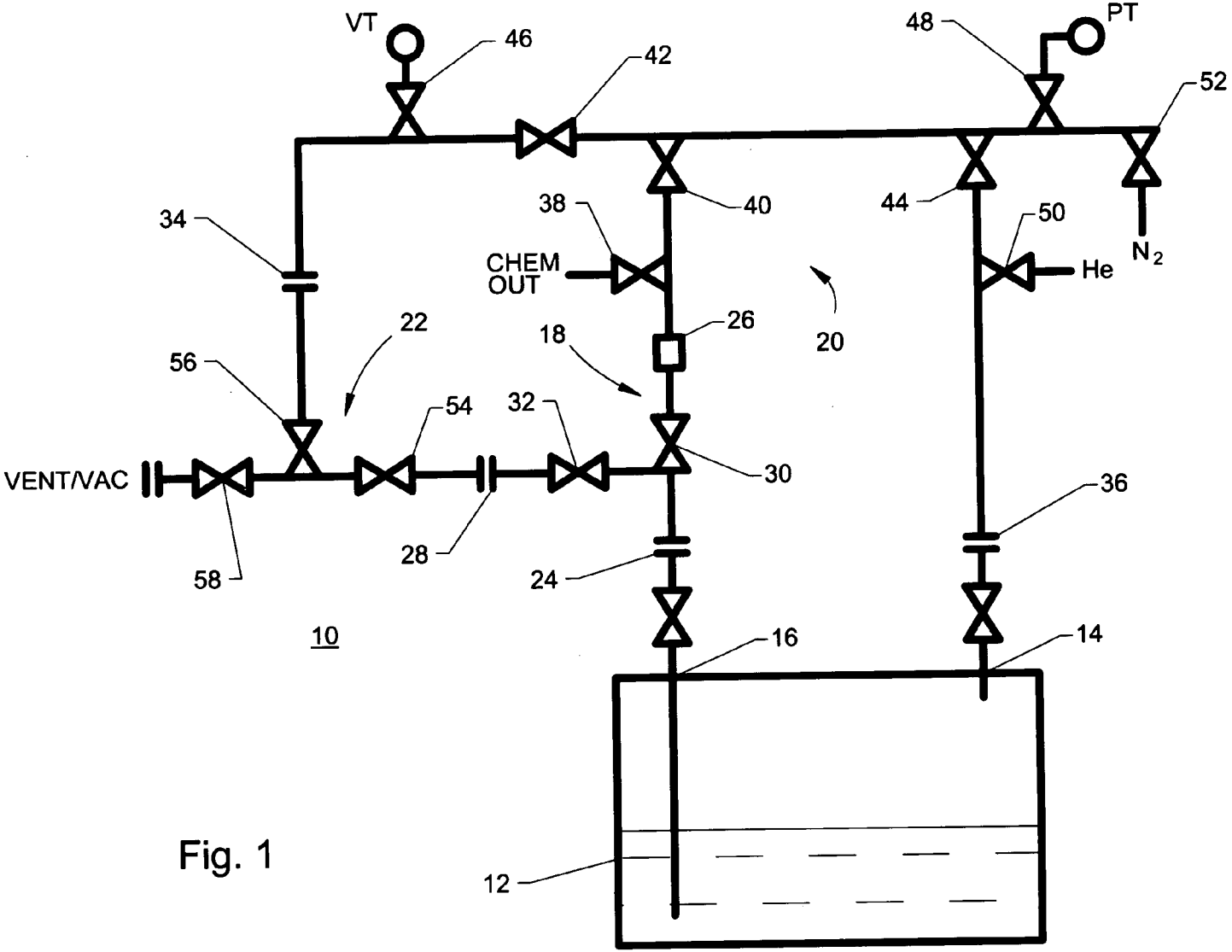
FIG. 1 is a schematic view of a first embodiment of the invention.

The following reference numerals were employed in the Figures:

FIG. 1

10 High purity chemical delivery system (first embodiment)
12 Container
14 Push gas inlet port
16 High purity chemical delivery port
18 First manifold
20 Second manifold
22 Third manifold
24 First low dead space connector
26 Second low dead space connector
28 Third low dead space connector
30 First diaphragm valve
32 Second diaphragm valve
34 Fourth low dead space connector
36 Fifth low dead space connector
38 Third diaphragm valve
40 Fourth diaphragm valve
42 Fifth diaphragm valve
44 Sixth diaphragm valve
46 Seventh diaphragm valve
48 Eighth diaphragm valve
50 Ninth diaphragm valve
52 Tenth diaphragm valve
54 Eleventh diaphragm valve
56 Twelfth diaphragm valve
58 Thirteenth diaphragm valve

FIG. 2

60 High purity chemical delivery system (second embodiment)
62 Container
64 Push gas inlet port
66 High purity chemical delivery port
68 First manifold
70 Second manifold
72 Third manifold
74 Third diaphragm valve
76 Eleventh diaphragm valve
78 Fourteenth diaphragm valve
80 Fifteenth diaphragm valve
82 First diaphragm valve
84 Fourth diaphragm valve
86 Sixth low dead space connector
88 Second diaphragm valve 88
90 First low dead space connector
92 Sixteenth diaphragm valve
94 Seventeenth diaphragm valve
96 Ninth diaphragm valve
98 Seventh low dead space connector
100 Fifth low dead space connector
102 Fifth diaphragm valve
104 Sixth diaphragm valve
106 Seventh diaphragm valve
108 Eighth diaphragm valve
110 Tenth diaphragm valve
112 Twelfth diaphragm valve
114 Thirteenth diaphragm valve
116 Push gas inlet valve
118 High purity chemical delivery valve

FIG. 4

120 Alternative embodiment of first manifold
122 First diaphragm valve
124 Sixteenth diaphragm valve
126 First low dead space connector

DETAILED DESCRIPTION OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Turning first to FIG. 1, there is shown a first embodiment of the invention, which is particularly suitable for use in a direct liquid injection process in semiconductor fabrication. A high purity chemical delivery system 10 is connected to a high purity chemical container 12 having a push gas inlet port 14 and a high purity chemical delivery port 16. High purity chemical delivery system 10 comprises a first manifold 18, a second manifold 20, and a third manifold 22. Each of the manifolds includes a plurality of diaphragm valves that regulate the flow of liquid or gas in the delivery system, and one or more low dead space connectors that attach each manifold to another manifold, to container 12, or to other parts of the manufacturing plant.

First manifold 18 is connected to container 12 by means of a first low dead space connector 24 (preferably a VCR fitting); to second manifold 20 by means of a second low dead space connector 26 (preferably a low obstruction fitting such as Fujikin's UPG gasket fitting or Hy-Tech's Full Bore 002); and to third manifold 22 by means of a third low dead space connector 28. First manifold 18 further comprises a first diaphragm valve 30 and a second diaphragm valve 32, wherein first diaphragm valve 30 has one side (preferably the seat side) connected to second low dead space connector 26, and the other side (preferably the diaphragm side) connected to both first low dead space connector 24 and second diaphragm valve 32. In turn, second diaphragm valve 32 has one side (preferably the seat side) connected to first diaphragm valve 30, and the other side (preferably the diaphragm side) connected to third low dead space connector 28.

Second manifold 20 is instead connected to third manifold 22 by means of a fourth low dead space connector 34, and to container 12 by means of a fifth low dead space connector 36 (preferably a VCR fitting). Second manifold 20 further comprises a plurality of diaphragm valves, including third diaphragm valve 38, which has one side (preferably the diaphragm side) connected to a high purity chemical utilization point, for instance, in a semiconductor manufacturing plant, to a process tool for semiconductor fabrication or to a second high purity chemical container, and the other side (preferably the seat side) connected to a fourth diaphragm valve 40. Fourth diaphragm valve 40 instead has one side (preferably the seat side) connected to third diaphragm valve 38, and the other side (preferably the diaphragm side) connected to a fifth diaphragm valve 42 and to a sixth diaphragm valve 44.

Further, fifth diaphragm valve 42 has one side (preferably the seat side) connected to fourth diaphragm valve 40, and the other side (preferably the diaphragm side) connected to a seventh diaphragm valve 46, which in turn has one side (preferably the diaphragm side) connected to fifth diaphragm valve 42 and to fourth low dead space connector 34, and the other side connected to a vacuum transducer, such as a manometer.

Still further, sixth diaphragm valve 44 has one side (preferably the diaphragm side) connected to an eighth diaphragm valve 48, and the other side (preferably the seat side) connected to a ninth diaphragm valve 50. In turn, eight diaphragm side 48 has one side (preferably the diaphragm side) connected to sixth diaphragm valve 44 and to one side (preferably the diaphragm side) of a tenth diaphragm valve 52, while the other side (preferably the seat side) of tenth diaphragm valve 52 is connected to a source of purge gas, such as nitrogen. Instead, ninth diaphragm valve 50 has one side (preferably the seat side) connected to sixth diaphragm valve 44 and to fifth low dead space connector 36, and the other side (preferably the diaphragm side) connected to a source of push gas, such as helium. Optionally, the conduit connecting ninth diaphragm valve 50 to fifth low dead space connector 36 may be divided in two segments connected by a low dead space connector (preferably, a low obstruction fitting), in order to facilitate installation of second manifold 20.

Third manifold 22 is connected to first manifold 18 by means of third low space connector 28, and to second manifold 20 by means of fourth low dead space connector 34. Third manifold 22 also comprises an eleventh diaphragm valve 54, a twelfth diaphragm valve 56, and a thirteenth diaphragm valve 58. More specifically, eleventh diaphragm valve 54 has one side (preferably the seat side) connected to third low dead space connector 28 and the other side (preferably the diaphragm side) connected to twelfth diaphragm valve 56. Instead, twelfth diaphragm valve 56 has one side (preferably the diaphragm side) connected to eleventh diaphragm valve 54 and to one side (preferably the seat side) of thirteenth diaphragm valve 58, while the other side of thirteenth diaphragm valve 58 (preferably the diaphragm side) is connected to an outer source, such as a source of vent or a source of vacuum.

The above embodiment has been described as having the first, second, and third manifolds connected by low dead space connectors; however, other means of connection may be employed, for instance, the first, second, and third manifolds may be welded to each other, or no connectors may be present and the manifolds may be connected to each other by means of continuous conduits.

Figure 2:
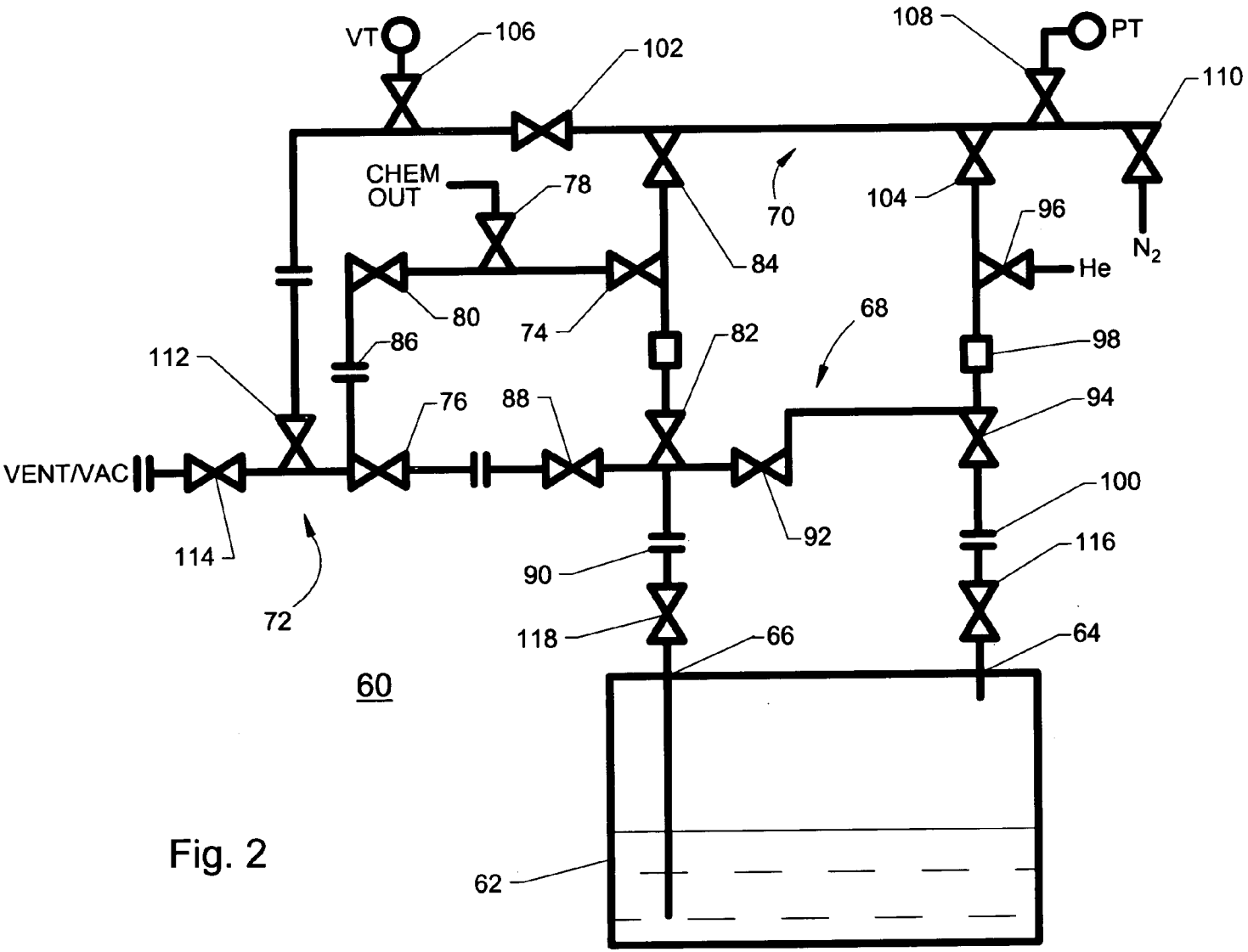
FIG. 2 is a schematic view of a second embodiment of the invention.

Turning now to FIG. 2, there is shown a second embodiment of the invention, which is also particularly suitable for use in a direct liquid injection process in semiconductor fabrication. A high purity chemical delivery system 60 is connected to a high purity chemical container 62 having a push gas inlet port 64 and a high purity chemical delivery port 66. High purity chemical delivery system 60 comprises a first manifold 68, a second manifold 70, and a third manifold 72, each of the manifolds comprising diaphragm valves to regulate the flow of liquid or gas, and low dead space connectors to attach each manifold to container 62, to other manifolds, or to other parts of the manufacturing plant.

The structure of this second embodiment may be readily understood by reference to the first embodiment, and by highlighting the differences between the two embodiments.

By comparing second manifold 20 in FIG. 1 to second manifold 70 in FIG. 1, it will be appreciated that second manifold 70 further comprises an additional flow connection between third diaphragm valve 74 and eleventh diaphragm valve 76, the additional flow connection comprising a fourteenth diaphragm valve 78 and a fifteenth diaphragm valve 80. More specifically, one side of third diaphragm valve 74 (preferably the seat side) is connected to first diaphragm valve 82 and to fourth diaphragm valve 84, while the other side (preferably the diaphragm side) is connected to one side of fourteenth diaphragm valve 78. In turn, fourteenth diaphragm valve 78 has one side (preferably the seat side) connected to third diaphragm valve 74 and to fifteenth diaphragm valve 80, and the other side (preferably the diaphragm side) connected instead to a high purity chemical utilization point, for instance, in a semiconductor fabrication plant, to a process tool or to a second high purity chemical container. Finally, one side (preferably the seat side) of fifteenth diaphragm valve 80 is connected to fourteenth diaphragm valve 78, and the other side (preferably the diaphragm side) is connected to eleventh diaphragm valve 76 in third manifold 72 by means of a sixth low dead space connector 86.

Further, in the second embodiment, one side of first diaphragm valve 82 (preferably the diaphragm side) is connected not only to second diaphragm valve 88 and to first low dead space connector 90, but also to one side of sixteenth diaphragm valve 92 (preferably the seat side), while the other side of sixteenth diaphragm valve 92 (preferably the diaphragm side) is connected to a seventeenth diaphragm valve 94. In turn, seventeenth diaphragm valve 94 has one side (preferably the seat side) connected to sixteenth diaphragm valve 92, and also to ninth diaphragm valve 96 through a seventh low dead space connector 98 (preferably a low obstruction fitting), while the other side of seventeenth diaphragm valve 94 (preferably the diaphragm side) is connected to fifth low dead space connector 100. Sixteenth diaphragm valve 92 is preferably positioned closer to first diaphragm valve 82 than to seventeenth diaphragm valve 94, in order to minimize the wet surface areas of the delivery system.

The second embodiment has been described as having the first, second, and third manifolds connected by low dead space connectors; however, other means of connection may be employed, for instance, the first, second, and third manifolds may be welded to each other, or no connectors may be present and the manifolds may be connected by means of continuous conduits.

One of the advantages of the high purity chemical delivery system according to the present invention is the reduction in purge cycle times compared to systems employed in the prior art. Following is one example of purge cycle described with reference to the second embodiment, using the appropriate reference numbers to identify each valve.

During operation:

Shut all valves. Open valves 96, 94, open push gas inlet valve 116, open high purity chemical delivery valve 118, open valves 82, 74, and 78. Apply push gas at source of push gas to push gas to deliver high purity chemical from container 62 to utilization point.

During purge:

a. Open valves 116, 94, 104, 102, 112, and 114. Shut all other valves. Apply vacuum at source of vacuum.
b. Open valves 96, 104, 84, 74, 82, and 118. Shut all other valves. Apply push gas at source of push gas.
c. Open valves 110, 104, 92, 88, 76, and 114. Shut all other valves. Apply purge gas at source of purge gas, and vent at source of vent.
d. Open valves 110, 84, 82, 88, 76, and 114. Shut all other valves. Apply purge gas at source of purge gas, and vent at source of vent.

e. Open valves 110, 84, 74, 80, and 114. Shut all other valves. Apply purge gas at source of purge gas, and vent at source of vent.

f. Apply vacuum to circuit open valves 104, 84, 102, 112, and 114.

g. Open valves 104, 84, 102, and 106. Shut all other valves. Measure vacuum level with vacuum transducer to measure presence of residual chemical. If chemical is present above predetermined levels, repeat cycle.

h. Open valves 110, 104, 94, 92, 88, 76, and 114. Shut all other valves. Apply purge gas at source of purge gas, and vent at source of vent, removing ambient gas after a new container is installed.

i. Open valves 110, 84, 82, 88, 76, and 114. Shut all other valves. Apply purge gas at source of purge gas, and vent at source of vent.

j. Open valves 110, 84, 74, 80, and 114. Shut all other valves. Apply purge gas at source of purge gas, and vent at source of vent.

k. Apply vacuum to circuit open valves 104, 84, 102, 112, and 114.

l. Open valves 106, 102, 84, 82, 92, 94, and 104. Shut all other valves. Check vacuum at vacuum transducer, monitoring possible leaks.

m. Open valves 114, 112, 106, 102, 84, 74, and 80. Shut all other valves. Apply vacuum at vacuum source, checking vacuum at vacuum transducer.

Figure 3:
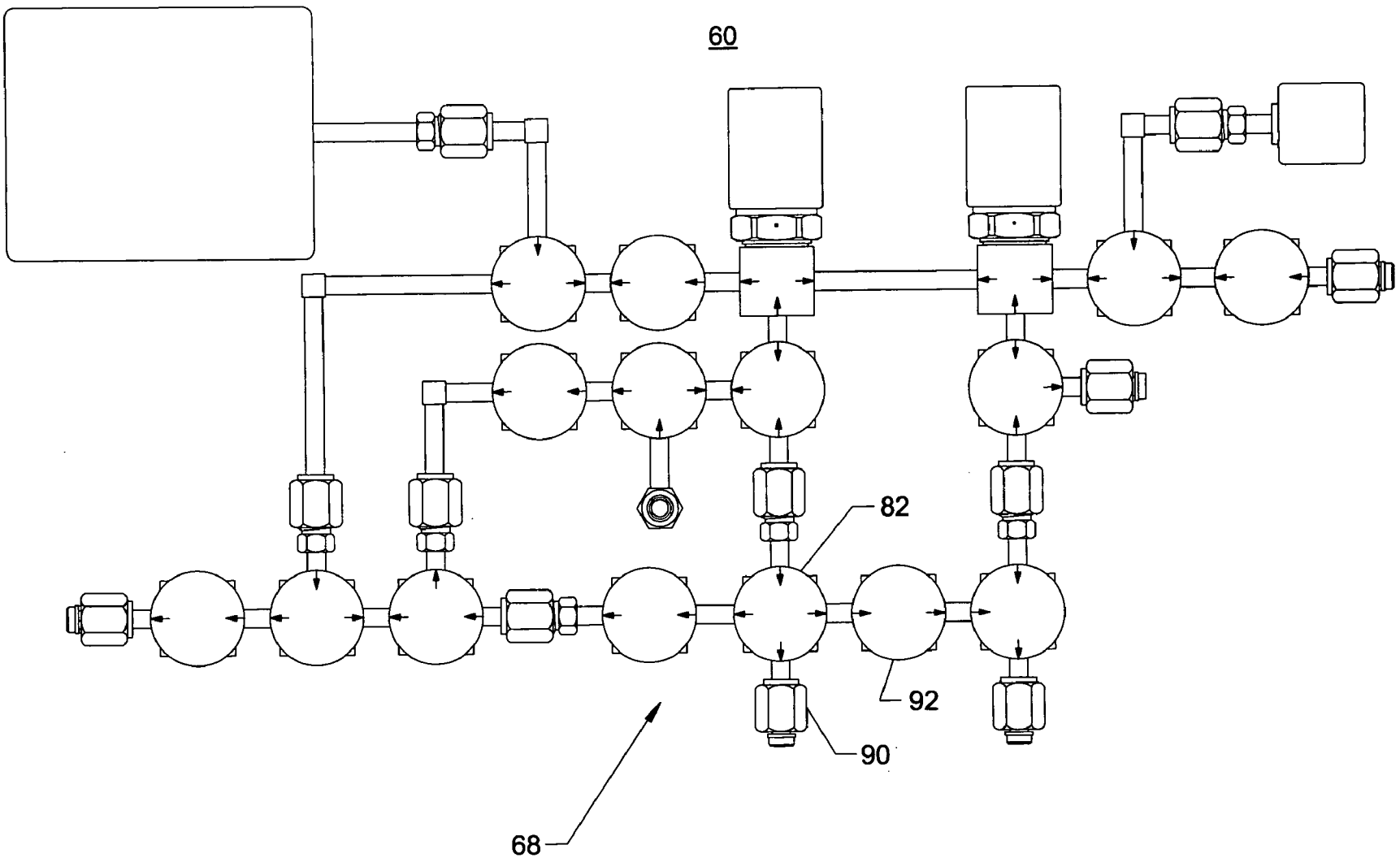
FIG. 3 is a front view of the second embodiment of the invention.
Figure 4:
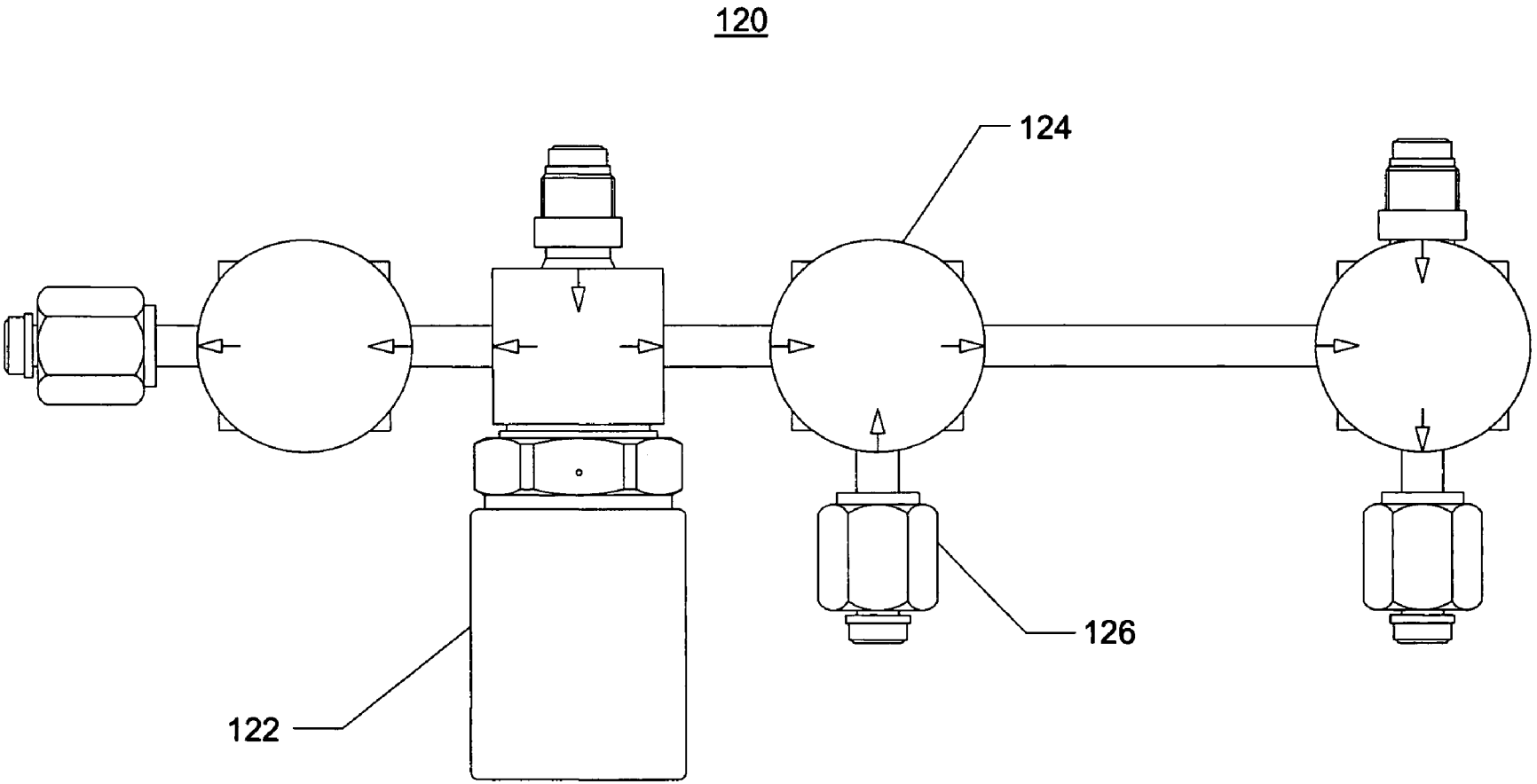
FIG. 4 is a front view of an alternate embodiment of a manifold of the second embodiment of the invention.

Turning now to FIGS. 3–4, there is shown in FIG. 3 a front view of the second embodiment of the invention, and in FIG. 4 a front view of an alternate embodiment 120 of first manifold 68. More specifically, first diaphragm valve 82 in first manifold 68 is connected to first low dead space connector 90, and is parallel and oriented in the same direction as sixteenth diaphragm valve 92. Instead, in alternate embodiment 120, first diaphragm valve 122 is parallel but rotated 90 degrees in relation to sixteenth diaphragm valve 124, in order to achieve direct flow into the valve seat. Further, in alternate embodiment 120, first connector 126 is connected not to first diaphragm valve 122, but to sixteenth diaphragm valve 124.

With further reference to FIG. 2, in a third embodiment of the invention there is no seventeenth diaphragm valve 94, and the sixteenth diaphragm valve 92 has one side (preferably the seat side) connected to the first diaphragm valve 82, and the other side (preferably the diaphragm side) connected to the fifth low dead space connector 100 and to the seventh low dead space connector 98.

The above embodiments have been described as having manifold comprising a plurality of discrete valves. Some of the valves, however, may be grouped in multi-valve blocks. For instance, in the first embodiment illustrated in FIG. 1, valves 30 and 32 may be clustered in a two-valve block, and valves 38 and 40, as well as 44 and 50, may also be clustered in two-valve blocks. Likewise, valves 54, 56, and 58 may be clustered in a three-valve block.

While the above described embodiments have been described with relation to a gas and vacuum purge process, the invention is equally adapted to a solvent purge process. Additionally, while the invention has been described in connection with the above described embodiment, it is not intended to limit the scope of the invention to the particular forms set forth, but on the contrary, it is intended to cover such alternatives, modifications, and equivalents as may be included within the scope of the invention.

What is claimed is:

1. A high purity chemical delivery system connected to a high purity chemical container, the high purity chemical container having a push gas inlet port and a high purity chemical delivery port, the high purity chemical delivery system comprising:

a first manifold comprising, first means for connecting the first manifold to the high purity chemical delivery port, second means for connecting the first manifold to a second manifold, third means for connecting the first manifold to a third manifold, a first diaphragm valve having one side connected to the first means for connecting and to a second diaphragm valve, and having the other side connected to the second means for connecting, and a second diaphragm valve having one side connected to the first diaphragm valve, and having the other side connected to the third means for connecting;

the second manifold comprising, fourth means for connecting the second manifold to the third manifold, fifth means for connecting the second manifold to the push gas inlet port, a third diaphragm valve having one side connected to the second means for connecting and to a fourth diaphragm valve, and having the other side connected to a high purity chemical utilization point, a fourth diaphragm valve having one side connected to the third diaphragm valve, and having the other side connected to a fifth diaphragm valve and to a sixth diaphragm valve, the fifth diaphragm valve having one side connected to the fourth diaphragm valve, and the other side connected to a seventh diaphragm valve;

the seventh diaphragm valve having one side connected to the fifth diaphragm valve and to the fourth means for connecting, and having the other side connected to a vacuum transducer, the sixth diaphragm valve having one side connected to the fourth diaphragm valve and to an eighth diaphragm valve, and the other side connected to a ninth diaphragm valve, the eight diaphragm valve having one side connected to the sixth diaphragm valve and to a tenth diaphragm valve, and having the other side connected to a pressure transducer, the ninth diaphragm valve having one side connected to the fifth means for connecting, and having the other side connected to a source of push gas, and the tenth diaphragm valve having one side connected to the eighth diaphragm valve, and having the other side connected to a source of purge gas; and the third manifold comprising, an eleventh diaphragm valve having one side connected to the third means for connecting, and having the other side connected to a twelfth diaphragm valve, the twelfth diaphragm valve having one side connected to the fourth means for connecting, and having the other side connected to the eleventh diaphragm valve and to a thirteenth diaphragm valve, and the thirteenth diaphragm valve having one side connected to the twelfth diaphragm valve, and having the other side connected to an outer source, wherein the outer source is a source of vent or a source of vacuum.

2. The high purity chemical delivery system of claim 1, wherein the first and fifth means for connecting are low dead space connector fittings, and the second means for connecting is a low obstruction fitting.

3. The high purity chemical delivery system of claim 1, wherein, the first diaphragm valve has the seat side oriented towards the second means for connecting, the second diaphragm valve has the diaphragm side oriented towards the third means for connecting, the third diaphragm valve has the diaphragm side oriented towards the high purity chemical utilization point, the fourth diaphragm valve has the seat side oriented towards the third diaphragm valve, the fifth diaphragm valve has the seat side oriented towards the fourth diaphragm valve, the sixth diaphragm valve has the seat side oriented towards the ninth diaphragm valve, the seventh diaphragm valve has the seat side oriented towards the vacuum transducer, the eighth diaphragm valve has the seat side oriented towards the pressure transducer, the ninth diaphragm valve has the seat side oriented towards the source of push gas, the tenth diaphragm valve has the seat side oriented towards the source of purge gas, the eleventh diaphragm valve has the seat side oriented towards the third means for connecting, the twelfth diaphragm valve has the seat side oriented towards the fourth means for connecting, and the thirteenth diaphragm valve has the seat side oriented towards the twelfth diaphragm valve.

4. The high purity chemical delivery system of claim 1, wherein groups of two valves may be clustered in two-valve blocks.

5. The high purity chemical delivery system of claim 1, wherein groups of three valves may be clustered in three-valve blocks.

6. A high purity chemical delivery system connected to a high purity chemical container, the high purity chemical container having a push gas inlet port and a high purity chemical delivery port, the high purity chemical delivery system comprising:

a first manifold comprising, first means for connecting the first manifold to the high purity chemical delivery port, second means for connecting the first manifold to a second manifold, third means for connecting the first manifold to a third manifold, fifth means for connecting the first manifold to the push gas inlet port, seventh means for connecting the first manifold to the second manifold, a first diaphragm valve having one side connected to the first means for connecting, to a second diaphragm valve, and to a sixteenth diaphragm valve, and having the other side connected to the second means for connecting, and a second diaphragm valve having one side connected to the first diaphragm valve, and having the other side connected to the third means for connecting, the sixteenth diaphragm valve having one side connected to the first diaphragm valve, and the other side connected to a seventeenth diaphragm valve, and the seventeenth diaphragm valve having one side connected to the fifth means for connecting, and the other side connected to the seventh means for connecting and to the sixteenth diaphragm valve;

the second manifold comprising, fourth means for connecting the second manifold to the third manifold, sixth means for connecting the second manifold to the third manifold, a third diaphragm valve having one side connected to the second means for connecting and to a fourth diaphragm valve, and having the other side connected to a fourteenth diaphragm valve, a fourth diaphragm valve having one side connected to the third diaphragm valve, and having the other side connected to a fifth diaphragm valve and to a sixth diaphragm valve, the fifth diaphragm valve having one side connected to the fourth diaphragm valve, and the other side connected to a seventh diaphragm valve;

the seventh diaphragm valve having one side connected to the fifth diaphragm valve and to the fourth means for connecting, and having the other side connected to a vacuum transducer, the sixth diaphragm valve having one side connected to the fourth diaphragm valve and to an eighth diaphragm valve, and the other side connected to a ninth diaphragm valve, the eight diaphragm valve having one side connected to the sixth diaphragm valve and to a tenth diaphragm valve, and having the other side connected to a pressure transducer, the ninth diaphragm valve having one side connected to the seventh means for connecting, and having the other side connected to a source of push gas, and the tenth diaphragm valve having one side connected to the eighth diaphragm valve, and having the other side connected to a source of purge gas, the fourteenth diaphragm valve having one side connected to the third diaphragm valve and a fifteenth diaphragm valve, and the other side connected to a high purity chemical utilization point, and the fifteenth diaphragm valve having one side connected to the fourteenth diaphragm valve, and the other side connected to the sixth means for connecting; and the third manifold comprising, an eleventh diaphragm valve having one side connected to the third means for connecting, and having the other side connected to a twelfth diaphragm valve and to the sixth means for connecting, the twelfth diaphragm valve having one side connected to the fourth means for connecting, and having the other side connected to the eleventh diaphragm valve and to a thirteenth diaphragm valve, and the thirteenth diaphragm valve having one side connected to the twelfth diaphragm valve, and having the other side connected to an outer source, wherein the outer source is a source of vent or a source of vacuum.

7. The high purity chemical delivery system of claim 6, wherein the first and fifth means for connecting are low dead space connector fittings, and the second and seventh means for connecting are low obstruction fittings.

8. The high purity chemical delivery system of claim 6, wherein, the first diaphragm valve has the seat side oriented towards the second means for connecting, the second diaphragm valve has the diaphragm side oriented towards the third means for connecting, the third diaphragm valve has the diaphragm side oriented towards the fourteenth diaphragm valve, the fourth diaphragm valve has the seat side oriented towards the third diaphragm valve, the fifth diaphragm valve has the seat side oriented towards the fourth diaphragm valve, the sixth diaphragm valve has the seat side oriented towards the ninth diaphragm valve, the seventh diaphragm valve has the seat side oriented towards the vacuum transducer, the eighth diaphragm valve has the seat side oriented towards the pressure transducer, the ninth diaphragm valve has the seat side oriented towards the source of push gas, the tenth diaphragm valve has the seat side oriented towards the source of purge gas, the eleventh diaphragm valve has the seat side oriented towards the third means for connecting, the twelfth diaphragm valve has the seat side oriented towards the fourth means for connecting, and the thirteenth diaphragm valve has the seat side oriented towards the twelfth diaphragm valve, the fourteenth diaphragm valve has the diaphragm side oriented towards the high purity chemical utilization point, the fifteenth diaphragm valve has the seat side oriented towards the fourteenth diaphragm valve, the sixteenth diaphragm valve has the seat side oriented towards the first diaphragm valve, and the seventeenth diaphragm valve has the seat side oriented towards the seventh means for connecting.

9. The high purity chemical delivery system of claim 6, wherein the sixteenth diaphragm valve is positioned closer to the first diaphragm valve than to the seventeenth diaphragm valve.

10. The high purity chemical delivery system of claim 6, wherein the first diaphragm valve and the sixteenth diaphragm valve are oriented parallel but with a 90 degree direction with respect to each other, and wherein the first means for connecting are connected to the sixteenth diaphragm valve and not to the first diaphragm valve.

11. The high purity chemical delivery system of claim 6, wherein there is no seventeenth diaphragm valve, and wherein the sixteenth diaphragm valve has one side connected to the first diaphragm valve, and the other side connected to the fifth means for connecting and to the seventh means for connecting.

12. The high purity chemical delivery system of claim 6, wherein groups of two valves may be clustered in two-valve blocks.

13. The high purity chemical delivery system of claim 6, wherein groups of three valves may be clustered in three-valve blocks.

* * * * *